United States Patent [19]

Takagi

[11] Patent Number: 4,996,557

[45] Date of Patent: Feb. 26, 1991

[54] JAM DETECTING AND DISPLAYING DEVICE IN AN IMAGE RECORDING APPARATUS

[75] Inventor: Atsushi Takagi, Kanagawa, Japan

[73] Assignee: Fuji Photo Film Co., Ltd., Kanagawa, Japan

[21] Appl. No.: 417,620

[22] Filed: Oct. 5, 1989

Related U.S. Application Data

[62] Division of Ser. No. 181,353, Apr. 14, 1988, Pat. No. 4,908,655.

[30] Foreign Application Priority Data

Apr. 14, 1987 [JP] Japan ..... 62-89824

[51] Int. Cl.[5] ..... G03G 15/00; B65H 7/06

[52] U.S. Cl. ..... 355/50; 355/206; 340/675; 340/286.13

[58] Field of Search ..... 355/50, 206, 209, 308, 355/309; 340/286 M, 7.5, 673–675, 679

[56] References Cited

U.S. PATENT DOCUMENTS 4,332,464 6/1982 Bartulis et al. ..... 355/209 X

*Primary Examiner*—Joan H. Pendegrass

*Attorney, Agent, or Firm*—Sughrue, Mion, Zinn, Macpeak & Seas

[57] ABSTRACT

An image recording apparatus has a jamming detecting and displaying device in which jamming detecting means detect the jamming of an image recording material in the apparatus, and jamming displaying means displays the position of the jamming and tells a procedure of eliminating the jamming which is provided by control means, so that the jamming can be readily eliminated.

2 Claims, 2 Drawing Sheets

JAM DETECTING AND DISPLAYING DEVICE IN AN IMAGE RECORDING APPARATUS

This is a divisional of Application No. 07/181,353 filed Apr. 14, 1988, now U.S. Pat. No. 4.908,655.

BACKGROUND OF THE INVENTION

This invention relates to image recording apparatuses such as copiers, and more particularly to a jamming detecting and displaying device in such an apparatus which detects and displays the jamming of a sheet-shaped image recording material which may occur during the conveyance or image recording operation.

A variety of image recording apparatuses using a sheet-shaped image recording material have been proposed in the art. In the apparatuses, a plurality of treatments are given to the image recording material to record an image thereon. In the case where a number of processing steps are required for the image recording operation, it is unavoidable that a relatively long path is required for conveyance of the image recording material. Accordingly, the number of positions where the image recording material may be jammed is increased. Therefore, in such apparatus, a plurality of image-recording-material detecting sensors are arranged along the image-recording-material conveying path to identify the location of the jamming of the image recording material. For instance when the jamming of the image recording material is detected by the sensors, the location of the jamming is displayed on the operating panel so that the jamming can be identified easily and readily eliminated.

Such a simple system is inadequate in the case of an image recording apparatus in which the image recording process is intricate and, accordingly, the image treating means and the image-recording-material conveying means are complicated. Even when the image recording material is jammed at only one position, several different operations are required to eliminate the jamming. Moreover, the operator cannot readily eliminate the jamming, using the available jamming eliminating members in the machine (i.e., knobs and levers that are operative to clear a jam or expose the path for manual clearing) without knowing the jamming eliminating procedure. Furthermore in the case where the jamming eliminating members are not assigned respectively to the positions where the jamming may occur, and in the case where the jamming eliminating members are operated in a preferred sequence or combination in order to eliminate the jamming at different positions, it is difficult for the operator to correctly select the jamming eliminating members to be used for elimination of the jamming. In short, the jamming cannot be readily eliminated.

SUMMARY OF THE INVENTION

Accordingly, an object of this invention is to eliminate the above-described difficulties accompanying a conventional image recording apparatus.

More specifically, an object of the invention is to provide a jamming detecting and displaying device for an image recording apparatus through which the jamming of an image recording material in the apparatus can be readily eliminated.

The foregoing object and other objects of the invention have been achieved by the provision of a jamming detecting and displaying device for an image recording apparatus which, according to the invention, comprises:

jamming detecting means for detecting the jamming of an image recording material in the apparatus; jamming displaying means for displaying the position where jamming occurs and a procedure for eliminating the jamming; and control means for providing a procedure for eliminating the jamming which has been detected by the jamming detecting means and applying the procedure to the jamming displaying means.

By using the device of the invention, both the location of the jamming detected by the jamming detecting means and the procedure for eliminating the jamming are displayed, so that the jamming can be readily eliminated.

The jamming displaying means may display the location of the jamming and the procedure for eliminating the jamming on one and the same member. The display means may be located, for instance, on the operating panel of the image recording apparatus. The location of the jamming may be displayed as follows: a schematic diagram outlining the arrangement of the image recording apparatus, including its various processing means, is displayed and light emitting elements provided at the positions of the processing means in the schematic diagram are selectively turned on to indicate the jamming. The procedure for eliminating the jamming is displayed as follows: 7-segment light emission display tubes are provided near the jamming eliminating members in the image recording apparatus so that the order of operation of the jamming eliminating members to be used is indicated by using the digits "1", "2", "3" and so forth.

The displaying means may be such that figures and/or characters are used to indicate the location of the jamming and to reproduce the precise procedure for eliminating the jamming.

Furthermore, the display unit may be so designed that the jamming eliminating members are in the form of knobs and levers and the order of operation thereof is displayed by using sentences. In addition to the sentences which are displayed simultaneously, the photo-sensitive material and/or image receiving sheet conveying paths in the apparatus are displayed in a manner that indicates the position of jamming by lighting. The display unit may also be so positioned that the operator can observe it when the front door of the apparatus is opened, or it may be disposed near the operating panel.

The technical concept of the invention is applicable to image recording apparatuses such as electronic photographing devices and laser printers which use sheet-shaped recording materials, especially to an image recording apparatus in which a sheet-shaped photo-sensitive material and a sheet-shaped image receiving material are treated in intricate manner. The jamming detecting and displaying device of the invention is particularly applicable to an image recording apparatus in which two conveyance systems are provided to transfer an image from the photo-sensitive material onto the image receiving material, and therefore the photo-sensitive material and/or the image receiving material may be jammed at many positions in the apparatus.

One example of an image recording apparatus in which a photo-sensitive material having microcapsules containing photo-sensitive compounds on a support and an image receiving material are stacked one on another and pressurized to form a visible image on the image receiving material has been disclosed by Japanese Patent Application No. 287492/1985.

One example of an image recording apparatus in which a thermal diffusion transfer type photo-sensitive material and an image receiving material are stacked one on another and heated to obtain a visible image has been disclosed by Japanese Patent Application No. 124407/1986 filed by the present applicant.

The nature, principle and utility of the invention will become more apparent from the following detailed description when read in conjunction with the accompanying drawings.

DETAILED DESCRIPTION OF THE PREFERRED EMBODIMENT

One preferred embodiment of this invention will be described with reference to the accompanying drawings.

Figure 1:
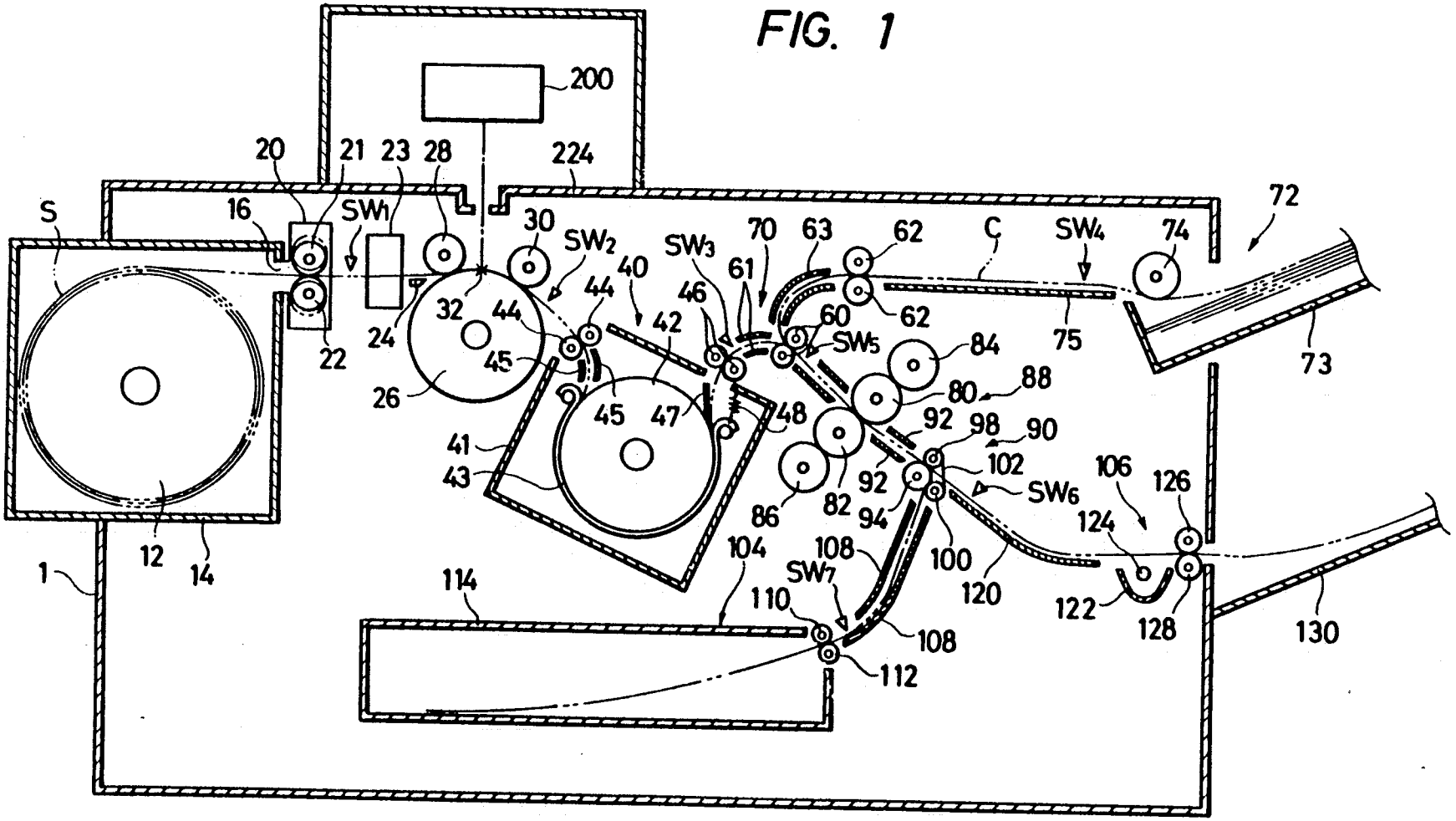
FIG. 1 is a sectional diagram of an image recording apparatus to which a jamming detecting and displaying device according to this invention is applied.

FIG. 1 is a sectional view of an image recording apparatus which uses a photo-sensitive pressure-sensitive thermal developing material (hereinafter referred to merely as "a photo-sensitive material") to record images.

As shown in FIG. 1, an exposure unit 200 is provided in the upper portion of a housing 1, and the part accommodating the exposure unit 200 is separated from the remaining part by a partition wall 224.

A photo-sensitive material magazine 14 holding a photo-sensitive material roll 12, which is formed by winding a photo-sensitive material S, is detachably mounted on one side of the housing 1. The magazine 14 has an outlet 16 through which the photo-sensitive material S is pulled out. A pair of photo-sensitive material supplying rollers 21 and 22, which are provided inside a magazine connecting dark box 20, are disposed at the outlet 16 of the magazine 14 so that the photo-sensitive material S is let out a predetermined length, or let in when necessary.

When the front end of the photo-sensitive material S approaches the photo-sensitive material supplying rollers 21 and 22, the latter 21 and 22 are spaced away from each other as indicated by the phantom lines to allow the movement of the photo-sensitive material S. A cutter unit 23 for cutting the photo-sensitive material S and a guide board 24 are arranged in front of the dark box 20 (as viewed in the direction of movement of the photo-sensitive material).

The photo-sensitive material nip rollers 28 and 30 are disposed in front of the guide board 124 in such a manner that they are abutted against an exposed photo-sensitive material supporting roller 26. The photo-sensitive material S being guided by the guide board 24 is brought into close contact with the exposed photo-sensitive material supporting roller 26 by means of the nip rollers 28 and 30 and is subjected to optical exposure at the position 32 between the nip rollers by the exposure unit 200 so that a latent image is formed thereon.

A thermal developing unit 40 for developing the exposed material S by heating is arranged in front of the supporting roller 26. The thermal developing unit 40 comprises: a developing housing 41 having a heat insulating effect; a conveying drum 42 arranged inside the housing 41 to convey the photo-sensitive material S while supporting it; and a heating board 43 which is pushed against the cylindrical wall of the conveying drum 42 by means of a spring 48 in such a manner as to cover about 240° of the conveying drum 42. That is, the unit 40 carries out a thermal developing operation while allowing the photo-sensitive material S to pass through the conveying drum 42 and the heating board 43. The unit 40 further comprises: a pair of conveying rollers 44 and a guide member 45 for guiding the photo-sensitive material S to the conveying drum 42; and a separating pawl 47 for separating the photo-sensitive material S from the conveying drum 42 to guide it to the nip region of a pair of conveying rollers 46.

In front of the conveying rollers 46, there is provided a photo-sensitive material and image receiving sheet stacking unit 70. The unit 70 comprises: a pair of pressuring rollers 60; a guide member 61 for guiding the photo-sensitive material S conveyed by the conveying rollers 46 to the nip region of the pressing rollers 60; and a guide member 63 for guiding to the nip region of the pressing rollers 60 an image receiving sheet C which has been supplied from an image-receiving-sheet supplying unit 72 and conveyed by a pair of conveying rollers 62.

The unit 72 is mounted on the other side of the housing 1, and comprises: an image-receiving-sheet cassette 73 containing a number of image receiving sheets C, a feeder roller 74 for selecting the top sheet C and passing it across plate 75, and the conveying rollers 62.

In front of the photosensitive material and image receiving sheet stacking unit 70, there is provided an image transfer unit 88. The unit 88 comprises: a pair of pressurizing nip rollers 80 and 82; and backup rollers 84 and 86 to make the pressurization of the nip rollers 80 and 82 uniform in the axial direction. The nip rollers 80 and 82 are pushed against each other under a pressure of about 500Kg/cm$^2$.

A photo-sensitive-material and image-receiving-sheet separating unit 90 is provided in front of the image transfer unit. The unit 90 comprises: a guide member 92; a conveying roller 94; guide rollers 98 and 100; and a separating belt 102 which is laid over the guide rollers 98 and 100 in such a manner that it is pushed against the photo-sensitive material S only at both sides of the conveying roller 94.

The separating unit 90 is followed by a photo-sensitive material disposal section 104. The section 104 comprises: a guide member 108; a pair of conveying rollers 110 and 112; and a disposal box 114. The photo-sensitive material S delivered from the separating unit 90 and guided by the guide member 108 is moved into the disposal box 114 by means of the conveying rollers 110 and 112.

The separating unit 90 is further followed by an image fixing unit 106. The unit 106 comprises: a guide member 120; an ultraviolet lamp 124 with a reflecting member 122; and a pair of conveying rollers 126 and 128. In the image fixing unit 106, ultraviolet rays are applied to the image receiving sheet C for about five (5) seconds which has been delivered from the separating unit 90 and guided by the guide member 120, so that the image is fixed.

A take-out tray 130 for receiving the image receiving sheet C thus processed is provided in front of the image fixing unit 106 in such a manner that it is protruded from the housing 1;

Sensors $SW_1$ through $SW_7$ for detecting the photo-sensitive material S and the image receiving sheet C are provided in the conveyance paths in the image recording apparatus. Time periods predetermined for conveying the photo-sensitive material S and the image receiving sheet C between the sensors have been stored in advance. Therefore, if, in the case where a photo-sensitive material S or image receiving sheet C is conveyed from a first sensor to a second sensor, the second sensor does not detect the photo-sensitive material S or image receiving sheet C within a predetermined time period after it was detected by the first sensor, then it will be assumed that a jam has occurred. Based on that assumption, the operation of the image recording apparatus is stopped.

The sensor $SW_1$ is located upstream of the exposure unit 200, the sensor $SW_2$ is located between the exposure unit 200 and the thermal developing unit 40, the sensor $SW_3$ is disposed between the thermal developing unit 40 and the stacking unit 70, the sensor $SW_4$ is arranged between the image receiving sheet supplying unit 72 and the stacking unit 70, the sensor $SW_5$ between the stacking unit 70 and the image transfer unit 88, the sensor $SW_6$ between the image transfer unit 88 and the image fixing unit 106; and sensor $SW_7$ between the image transfer unit 88 and the photo-sensitive material disposal section 104. The number of sensors and the arrangement of them described above are not limitative. That is, the sensors can be positioned upstream and downstream of each of the positions where jamming of the photo-sensitive material S or image receiving sheet C may occur.

Figure 2:
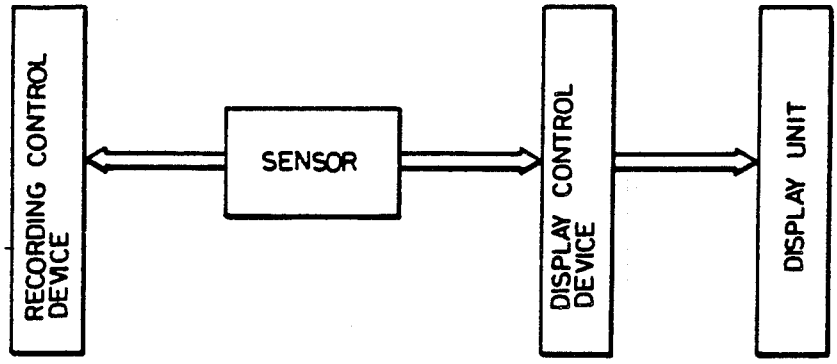
FIG. 2 is a block diagram showing a control system which is operated when an image recording material is jammed in the image recording apparatus.

FIG. 2 is a block diagram for a description of the control which, upon occurrence of jamming, is carried out on a detection signal outputted by any one of the sensors. When the sensor detects the jamming of the photo-sensitive material S or image receiving sheet C, a recording control device receives the detection signal from the sensor, to suspend the operation of the image recording apparatus. At the same time, the detection signal is applied to a display control device so that the position where the jamming has occurred and a procedure for eliminating the jamming are displayed on a display unit.

Figure 3:
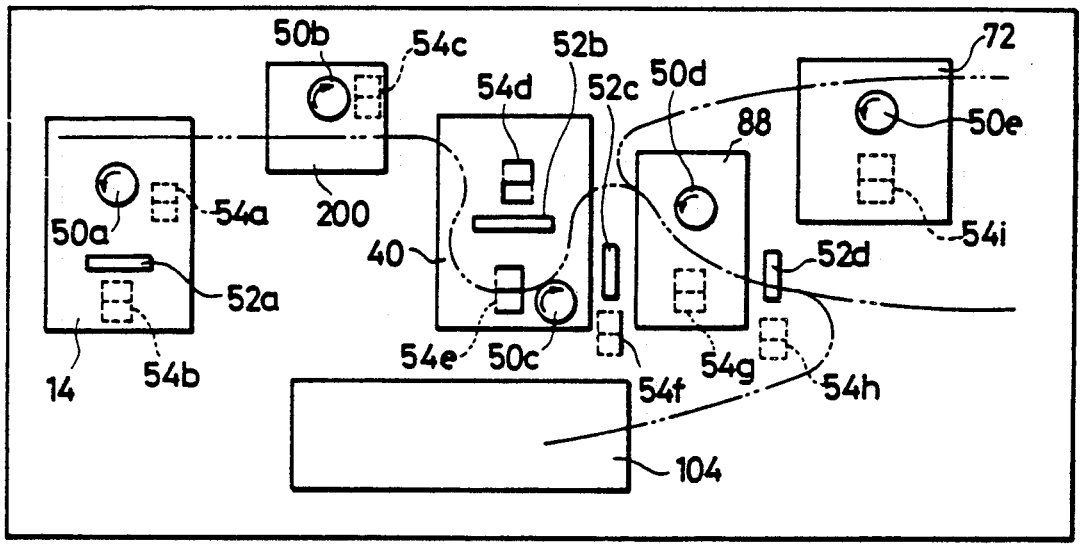
FIG. 3 is a diagram outlining the arrangement of the image recording apparatus.

FIG. 3 is a diagram outlining the image recording apparatus with the front door opened, showing the photo-sensitive material magazine 14, the exposure unit 200, the thermal developing unit, the image receiving sheet supplying unit 72, the image transfer unit 88, and the photo-sensitive material disposal section 104. As shown in FIG. 3, the image recording apparatus has jam eliminating structure comprising knobs 50*a* through 50*e* and operating levers 52*a* through 52*d* which are operated when jamming occurs. The unit also has 7-segment light emission display tubes 54*a* through 54*i* capable of displaying the digits "0" through "9". These display tubes are provided near the knobs 50*a* through 50*e* and the levers 52*a* through 52*d*, respectively. Display tubes 54*a* through 54*i* are controlled by the display control device. When jamming is located by the display control device according to the jamming detection signals outputted by the sensors $SW_1$ through $SW_7$, only the display tubes provided beside the knobs and the levers which should be operated for elimination of the jamming are turned on. In this connection, the display control device determines the order of operation of the knobs and the levers and applies it to the display tubes, so that the order of operation of the knobs and the levers is displayed on the concerned display tubes.

For instance in the case where the occurrence of jamming in the thermal developing unit 40 is detected with the aid of the sensors $SW_2$ an $SW_3$, the display tubes 54*f*, 54 *d* and 54*e* provided for the levers 52*c* and 52*b* and the knob 50*c* which are operated to expose the photo-sensitive material conveying path in the thermal developing unit 40 are turned on to display the digits "1", "2" and "3", respectively, which shown the order of operation.

In the above-described apparatus, the display tube is provided for each of the jamming eliminating members. However, the apparatus may be modified to provide a display unit which displays a diagram of the sheet flow arrangement and the location of the jammed sheet, as shown in FIG. 3. In the modification, it is preferable that the display unit be positioned so that, with the front door of the image recording apparatus opened, it is possible for the operator to observe the display unit while referring to the components in the apparatus. If necessary, the display unit may be arranged near the operating panel of the image recording apparatus.

Figure 4:
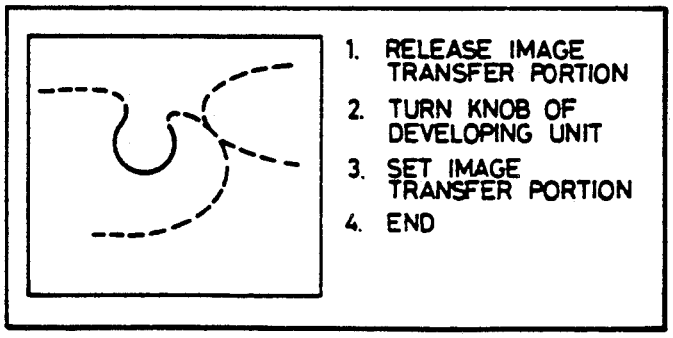
FIG. 4 is an explanatory diagram showing a display unit in the jamming detecting and displaying device of the invention.

Furthermore, the display unit may be so designed that the jamming eliminating members and the order of operation thereof are displayed by using sentences, as shown in FIG. 4. The display unit also may be so modified that in addition to the sentences, the photo-sensitive material and/or image receiving sheet conveying paths in the apparatus are displayed in a manner that indicates the position of jamming by lighting. FIG. 4 shows the occurrence of jamming in the thermal developing unit. The display unit also may be so positioned that the operator can observe it when the front door of the apparatus is opened, or it maybe disposed near the operating panel.

As was described above, in the jamming detecting and displaying device according to the invention, the jamming detecting means detects the position where the recording material has been jammed, the display control means controls the operation of the display means according to the jamming detection signal, and the display means displays the position where the jamming has occurred and the procedure of eliminating the jamming. Therefore, the position where the jamming has occurred in the image recording apparatus can be recognized with ease, and even a person who is not skilled in the maintenance and repair of such apparatus can eliminate the jamming by following the procedure displayed. The technical concept of the invention is applicable especially to an image recording apparatus which transports sheet materials in an intricate path and has several jamming eliminating members that are operated in a preferred sequence or combination for elimination of the jamming at different positions.

What is claimed is:

1. A jamming detecting and displaying device in an image recording apparatus, having jamming clearing members including a plurality of knobs and levers, which comprises:

jamming detecting means for detecting the jamming of an image recording material in said image recording apparatus;

jamming displaying means for displaying the position where jamming occurs and information concerning procedures for eliminating said jamming; and control means responsive to said detecting means for determining a procedure for eliminating said jamming and controlling said jamming displaying means to display information concerning said procedure, wherein said displaying means displays information concerning said procedure in a manner comprising simultaneously displayed sentences to identify the sequence and combination in which said plurality of knobs and levers should be operated, wherein said displaying means is positioned such that an operator of the image recording apparatus can observe said displaying means when a front door of the image recording apparatus is opened.

2. A device as claimed in claim 1, wherein said displaying means also displays a sheet travel path and indicates said position where jamming occurs by lighting the corresponding portion of said path.

* * * * *